United States Patent [19]

Fratzke et al.

[11] 4,184,146

[45] Jan. 15, 1980

[54] WARNING SYSTEM

[75] Inventors: Lawrence F. Fratzke, East Peoria; Joe E. Fuzzell, Peoria, both of Ill.

[73] Assignee: Caterpillar Tractor Co., Peoria, Ill.

[21] Appl. No.: 791,909

[22] Filed: Apr. 28, 1977

[51] Int. Cl.[2] ..... G08B 19/00

[52] U.S. Cl. ..... 340/52 F; 307/10 R; 340/517

[58] Field of Search ..... 340/52 F, 412, 413, 340/414, 415, 213 Q, 500, 517, 518, 519, 520, 521; 307/10 R

[56] References Cited

U.S. PATENT DOCUMENTS

| | | | |
|---|---|---|---|
| 3,911,373 | 10/1975 | Ohtake et al. | 331/65 |
| 3,944,969 | 3/1976 | Arai et al. | 340/52 F |
| 3,949,356 | 4/1976 | Fuzzell et al. | 340/52 F |
| 4,034,335 | 7/1977 | Harazoe et al. | 340/52 F |
| 4,034,336 | 7/1977 | Arai | 340/52 F |
| 4,053,868 | 10/1977 | Cox et al. | 340/52 F |

*Primary Examiner*—Donald J. Yusko
*Assistant Examiner*—Joseph E. Nowicki
*Attorney, Agent, or Firm*—Phillips, Moore, Weissenberger, Lempio & Majestic

[57] ABSTRACT

A system for giving warning of the existence of an undesirable state of one or more of a plurality of monitored operating conditions of an engine-powered vehicle. Three degrees of warning are given, depending upon the criticality of the monitored condition. Individually energizable low-intensity warning indicators are provided for each of the monitored conditions, and a multiplexing circuit is provided for staggered pulsing of these indicators. The existence of any critical fault will cause an intermittent operation of a more intense warning device, while the existence of a highly critical fault will give an additional intermittent warning of a still greater degree of intensity.

36 Claims, 4 Drawing Figures

WARNING SYSTEM

BACKGROUND OF THE INVENTION

This invention relates to a monitor system for an engine-powered vehicle wherein the presence of an undesirable operating condition of the vehicle is detected and a warning given to the operator.

In engine-powered vehicles of all kinds, monitor devices are employed to detect the presence of various undesirable operating conditions, such as overheating of the engine, low oil pressure, low fuel and the like, and indicators are provided to give warning to the operator of such conditions. In some vehicles similar instruments are provided to indicate operating faults distinct from the engine. As, for examples, earthmoving vehicles often have an engine-powered pump which supplies pressurized fluid to hydraulic cylinders for manipulating elements of the vehicle; instruments may be present to indicate low levels of hydraulic fluid, a clogging of the hydraulic fluid filter, and so on.

The importance of the various monitored conditions usually varies as to criticality. For example, the air filter for the engine or the filter for the hydraulic fluid may gradually clog during operation of the vehicle. Such clogging should be detected and the operator warned thereof, but generally there is no need to remedy the situation until the end of the day and the vehicle returns for normal servicing and maintenance. A low fuel condition requires more immediate attention on the part of the operator. A loss of engine oil pressure or a loss of hydraulic fluid represent conditions which require immediate attention to protect the vehicle from damage.

Heretofore, monitor systems have detected the presence of undesirable conditions and then signaled the vehicle operator by means of dial indicators, indicator lamps of audible means. The efficiency of these systems is greatly dependent upon the operator's careful attention to all of the various indicators and upon his judgement as to which may call for immediate correction. In general, the more complex the vehicle, the greater is the number of operating conditions that should be monitored. At the same time, the more complex the vehicle, the less the time that the operator will have to observe the greater number of various indications since he will be more immediately concerned with direct vehicle operation.

Thus, with an increasing amount of instrumentation, a definite problem exists as to how the existence of undesirable conditions can be detected and presented to the operator without a need on his part to give greater attention, which he does not have, to such instrumentation and make value judgments relative to the criticality of undesirable conditions.

Also, with an increasing amount of instrumentation, an increased amount of power is required to energize the various warning devices to a degree wherein a warning of sufficient intensity is given. This presents problems of excessive battery drain and design of monitor system which may be used in vehicles having batteries of widely different voltage ranges.

SUMMARY OF THE INVENTION

The present invention is directed to overcoming one or more of the problems as set forth above.

According to the present invention, a monitor system is provided wherein a plurality of operating conditions are monitored. If any of the monitored conditions has an undesirable state, a relatively low-intensity warning of such state of that particular condition is given so that the operator may know exactly which undesirable condition is present. If the monitored condition is of low criticality, no further alarm is given, so that the operator will not be subject to undue distraction. If the monitored condition is one of those requiring a more immediate attention, a general alarm, of greater intensity, is given. If the condition is of high urgency, an additional general alarm, of high intensity, is given.

Also according to the present invention, wherein a relatively low-intensity warning indicator is provided for each monitored condition, the indicators are divided into two groups and a multiplexing circuit is provided wherein any indicator will be pulsed if a fault occurs, with the pulsing of an indicator of the first group being staggered in time from the pulsing of a second group indicator. The pulsing of the indicators enables higher peak power to be applied so that the intensity of the energized indicator is increased, which is particularly advantageous if light-emitting diodes are used. The staggered operation of the two groups reduces the maximum power that the monitor system requires for operation.

Also according to the present invention, an oscillator is provided in connection with the general alarm indicators, preferably a relatively high-intensity light and a horn, so that these alarms will repeatedly go on and off in response to the presence of an undesirable state condition. Such intermittent operation will both save power while at the same time providing an alarm which is more noticeable than a steady-state alarm.

Also according to the invention, a further oscillator is provided for a relatively high-frequency energization of a horn during the time that it is intermittently operated by the general alarm oscillator.

Further according to the invention, the various low-intensity warning indicators may be easily tested for operability by the vehicle operator.

BRIEF DESCRIPTION OF THE DRAWINGS

In the drawings, forming a part of the application and in which like parts are designated by like reference numerals throughout the same.

DESCRIPTION OF THE PREFERRED EMBODIMENT

Figure 1A:
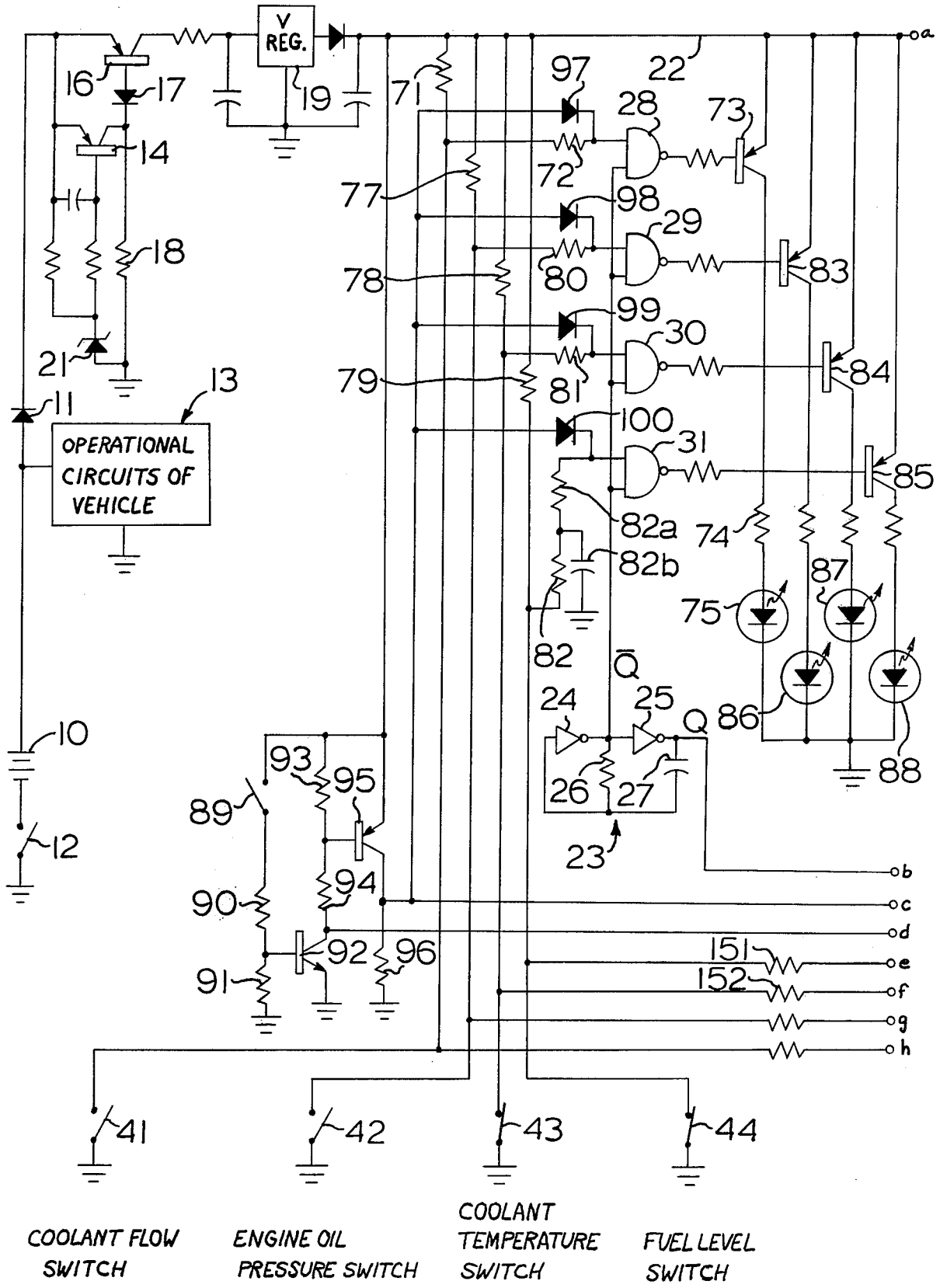
FIGS. 1A, 1B and 1C are a circuit diagram of the indicator panel and the operating-condition-responsive sensors monitored thereby.
Figure 1B:
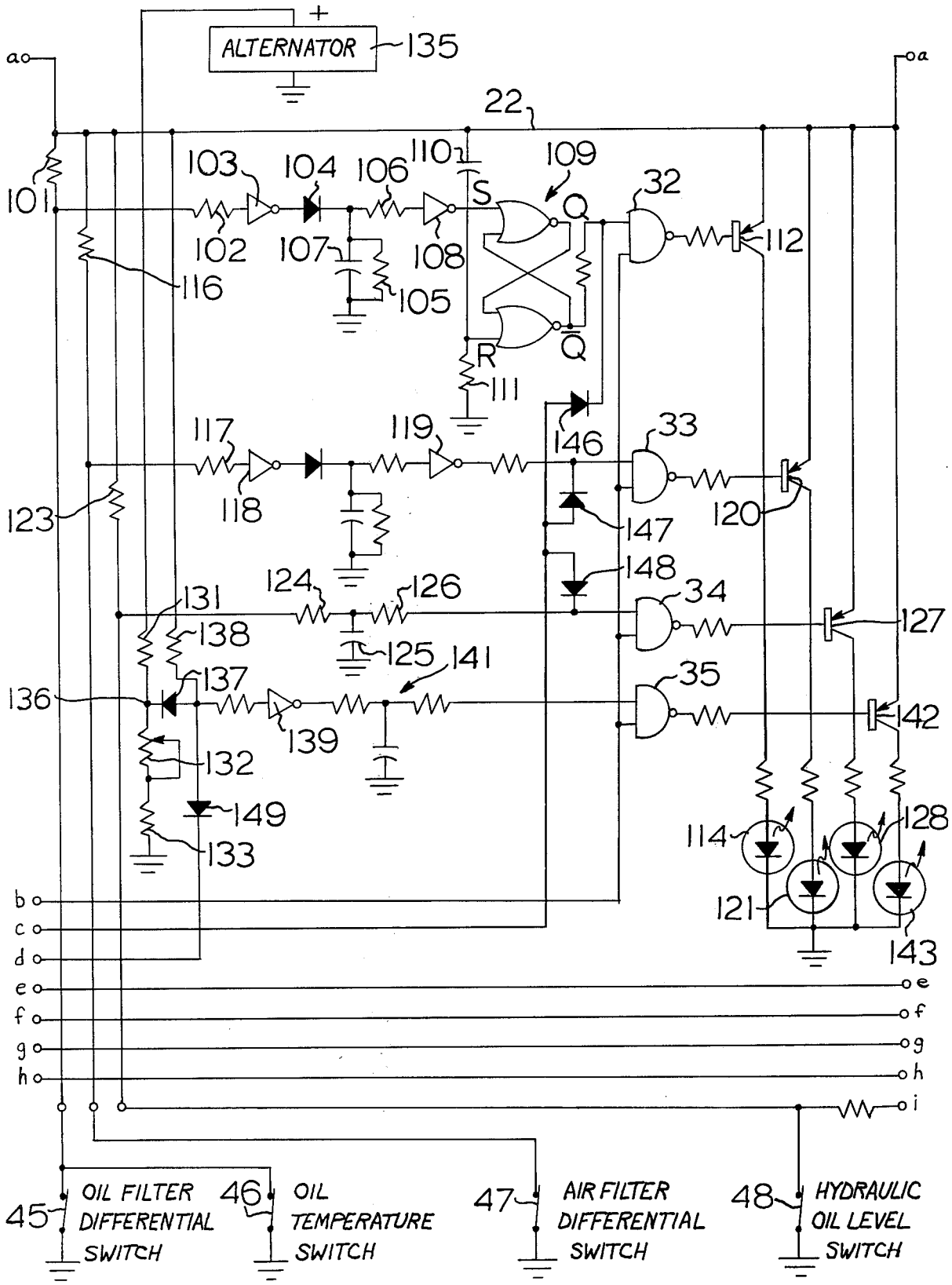
Figure 1C:
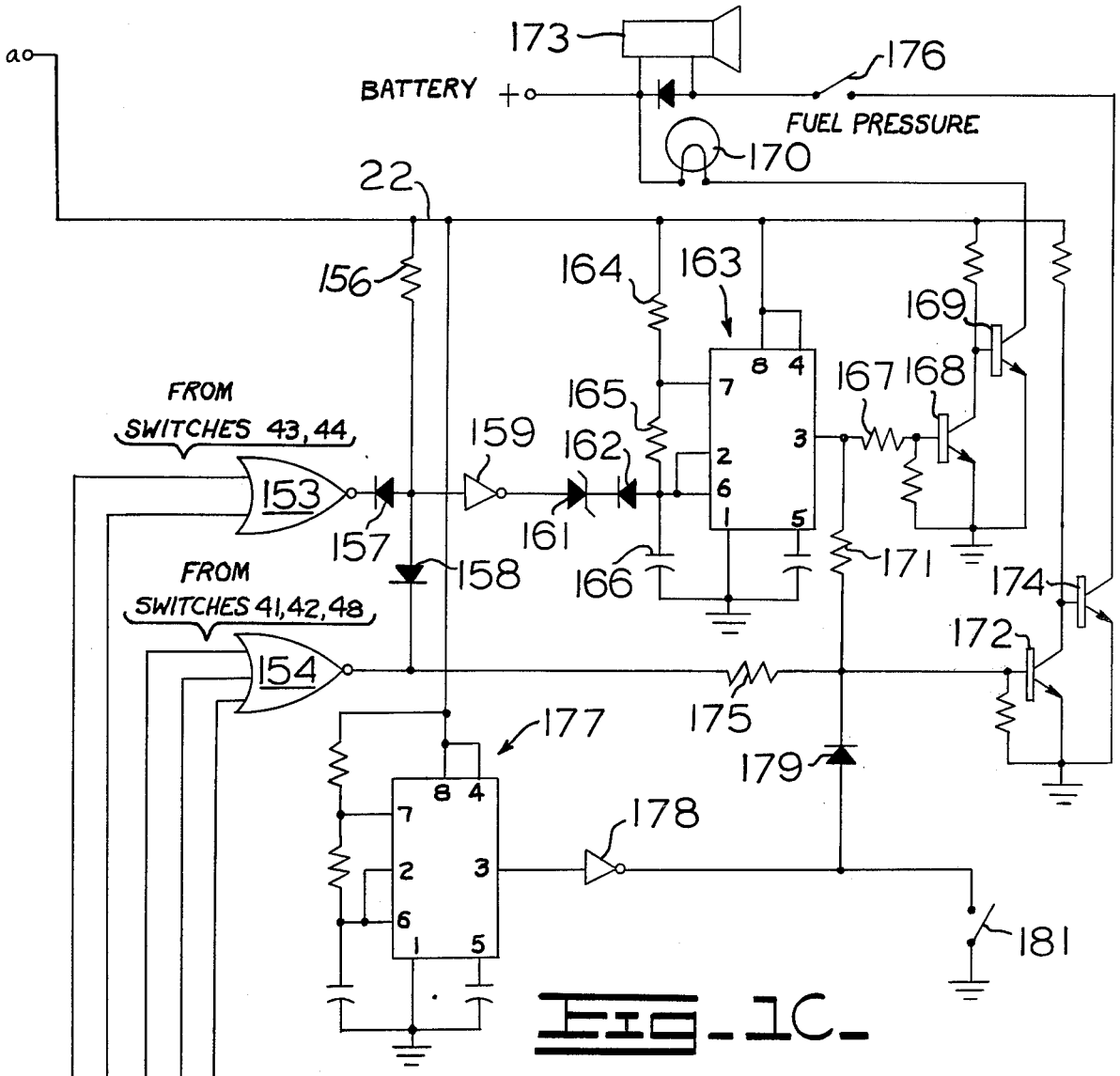

Referring now to the drawings, FIGS. 1A, 1B and 1C illustrate the monitor system of the present invention wherein a plurality of operating conditions of an engine-driven vehicle are monitored and warnings are given to the vehicle operator if a malfunction exists, the warnings being of different degree depending upon the criticality of the monitored condition.

Battery voltage from battery 10 is applied to the system through diode 11 when the vehicle disconnect switch 12 is closed to supply power to the operational circuits 13 of the vehicle. If the battery voltage is normal, transistor 14 is off, so that the base of transistor 16 is connected through diode 17 and resistor 18 to ground, allowing transistor 16 to conduct and apply battery current to voltage regulator 19. If the battery voltage should be excessive and exceed the breakdown potential of zener diode 21, transistor 14 will conduct and turn off transistor 16. This will safeguard voltage regulator 19 and the indicator circuits powered therefrom in the event of transient pulses from the charging circuit (not shown) for the battery. When transistor 16 is on, a regulated positive voltage will appear on bus 22.

An inverter oscillator 23, comprised of inverters 24 and 25, resistor 26 and capacitor 27 is provided and continuously oscillates at a frequency of about 11 or 12 Hz. The oscillating $\overline{Q}$ output, from inverter 24, is coupled to one of the inputs of each of NAND gates 28, 29, 30 and 31, while the Q output from inverter 25 is coupled (FIG. 1B) to one of the inputs of each of NAND gates 32, 33, 34 and 35. The Q output will be high when the $\overline{Q}$ output is low and vice versa, so that the Q and $\overline{Q}$ outputs will be operative during different portions of each cycle of operation of the oscillator.

Each of the NAND gates used herein comprises a gate means having two inputs and an operative output when an operative signal is applied to both of the inputs. As is apparent, oscillator 23 is coupled to the NAND gates so that each high Q output of the oscillator will apply operative signals to one of the inputs of each of NAND gates 32–35 and so that each high $\overline{Q}$ output of the oscillator will apply operative signals to one of the inputs of each of NAND gates 28–31. High, operative signals will be applied to the other input of each of the gates in response to a detection of an undesirable state of one or more of the conditions being monitored, as more fully described hereinafter.

A plurality of monitor devices, shown herein as condition-responsive switches 41–48, provide input signals to affect the monitor circuits. These switches are shown in the state for a condition where disconnect switch 13 is open and the vehicle engine is shut down. Switches 41 and 42 are conventional, normally open devices which close when the engine is running and the coolant flow and engine oil pressure are normal. Switches 43 and 46 are conventional, normally closed thermal trip devices which open only when the medium in which they are located, i.e., the engine coolant and engine oil, respectively, exceeds a specific value. Switches 44 and 48 are conventional fluid-level devices which are normally closed and which will open if the fluid level, i.e., the fuel or hydraulic oil, respectively, is below a normal limit. Pressure-responsive switches 45 and 47 are normally closed, but will open when the pressure differential across the monitored filter, i.e., the oil and air filters, respectively, exceeds a predetermined amount—indicating the existence of a clogged filter which needs cleaning or replacement.

The coolant flow switch 41 is coupled through resistor 71 to the positive bus 22 and through resistor 72 to the other input of gate 28. When the coolant flow switch is closed, as it will be if the flow is normal, the junction of resistors 71 and 72 will be grounded to provide a low input to gate 28. As a consequence, the output of gate 28 will be high regardless of the level of the $\overline{Q}$ output from oscillator 23. The high output of gate 28 will hold transistor 73 off. In the event the rate of coolant flow is below normal, switch 41 will open in response to this undesirable state condition of the coolant, the lower end of resistor 71 will be ungrounded and a high operative signal will be applied to gate 28. Each time then that the $\overline{Q}$ output of oscillator 23 goes high (11 or 12 times a second), gate 28 will have a low operative output which will turn transistor 73 on so that current may flow through resistor 74 to light-emitting diode (LED) 75 which serves as a relatively low-intensity warning indicator. LED 75 will then be pulsed at the oscillation rate of oscillator 23.

In like manner switches 42 and 43 are connected by resistors 77 and 78 to positive bus 22, and the lower ends of these resistors are connected through resistors 80 and 81 to gates 29 and 30 respectively. If either switch 42 or 43 opens in the event of a malfunction, the transistor 83 or 84 associated therewith will be turned on and the LED 86 or 87 associated therewith will be energized in a manner as set forth above.

Fuel level switch 44 is similarly connected by resistor 79 to positive bus 22, but the connection of the lower end of resistor 79 to gate 31 differs from the above in that such connection is through resistors 82 and **82*a*, with capacitor 82*b* being connected from the junction of resistors 82 and 82*a* to ground. With this arrangement, when switch 44 opens and ungrounds the junction of resistors 79 and 82, an immediate high voltage will not be applied to the upper input to gate 31, since capacitor 82*b* is initially in discharged state. When switch 44 opens, capacitor 82*b* will start charging through resistors 82 and 79. If switch 44 remains open, the charge across capacitor 82*b* will in due time increase to a point wherein its charge, applied through current-limiting resistor 82*a* to the upper input to gate 31, will be sufficiently high that the output of gate 31 will go low when the lower input, from oscillator 23, is high. Thus a time delay between the time that switch 44 opens and the time that transistor 85 will be turned on and LED 88 is energized. If the switch 44 recloses during the time delay, capacitor 82*b* will discharge through resistor 82 and LED 88 will not be energized. The time delay for LED 88** to be energized in response to a continued open position is predetermined by the RC values and should be long enough so that normal sloshing of the fuel in the fuel tank will not cause a premature alarm.

As mentioned above, oscillator 23 operates at about 11 or 12 Hz. At that rate, the LED pulsing is readily discernible. One of the reasons for pulsing the LED's is to enhance their use as a warning indicator. Most LED's, when energized steadily at rated power, produce a highly directional, low-level light that is below the intensity desirable for a warning indicator. However, when they are pulsed, they can be driven intermittently at a power level above rated without seriously affecting their service life as long as the average power is near rated. This mode of operation causes an apparent increase in the intensity of the light. Such increased apparent brilliance, combined with the discernible pulsing, serves to attract the attention of the vehicle operator in a quite effective manner.

The above-described indicator circuits may be tested by the operator by means of the manually operable test switch 89. When closed to its operative position, current flow through resistors 90 and 91 will turn on transistor 92, allowing the current flow through resistors 93 and 94 to turn on transistor 95 and raise the voltage level at the upper end of resistor 96 from ground to essentially that of bus 22. This high potential is applied through isolation diodes 97, 98, 99 and 100 to the inputs of gates 28–31 to simulate the effect if all of switches 41–44 were open. Thus, the closing of the test switch 89 will apply an operative signal to all of gates 28–31 at the same inputs thereof and of the same character, i.e., high, as the operative signal applied in response to opening of the switches 41–44. All LED's 75, 86, 87 and 88 will pulse simultaneously in synchronism with the high $\overline{Q}$ output of oscillator 23.

Turning now to FIG. 1B, the condition of the engine oil filter is monitored by means of pressure-responsive switch 45 which is normally closed but will open if the pressure differential across the filter exceeds a predetermined amount, as will be the case if the filter is clogged. This switch is connected through resistor 101 to positive bus 22. When switch 45 is closed, and it is normally, a low will be inputted through resistor 102 to inverter 103 so that the output thereof will be high. This high is applied through diode 104 and a delay circuit comprised of resistors 105 and 106 and capacitor 107 to inverter 108, which will apply a low signal to the set input S of the flip-flop 109. This flip-flop has its reset input R connected to the junction of capacitor 110 and resistor 111, for automatic resetting on power-up operations. The normally low $\overline{Q}$ flip-flop output is applied to gate 32, together with the pulsating Q output of oscillator 23 (FIG. 1A). As long as the $\overline{Q}$ output of flip-flop 109 remains low, gate 32 will output a high to prevent transistor 112 from conducting and LED 114 from being energized.

The oil temperature switch 46 is connected in parallel with switch 45, switch 46 being set to open when the oil has warmed in initial engine operation. This will prevent erroneous fault detection as might occur on initial engine operation when the oil is cold and sluggish. Once the oil warms, switch 46 will open to allow the fault detection circuit to respond to an opening of switch 45.

In the event switch 45 does open to unground inverter 103, the output thereof will go low, allowing capacitor 107 to discharge through resistor 105 so that a low is inputted into inverter 108, causing its output to go high. The normally high charge on capacitor 107 will prevent a momentary opening of switch 45 from affecting the output of inverter 108. With the output of inverter 108 high, flip-flop 109 is set and its $\overline{Q}$ output will go high. Now, each time that the Q output of oscillator 23 goes high, gate 32 will output a low to turn on transistor 112 and cause LED 114 to be energized.

Flip-flop 109 latches the fault indication since, once set, it will maintain a high $\overline{Q}$ output until the main switch 13 is opened to remove power from the circuit. This will enable the fault indication to remain and increase the likelihood of proper maintenance when the vehicle returns from operations.

The air filter differential switch 47 is similarly connected to the junction of resistors 116 and 117. When switch 47 opens, as from a clogged air filter, inverter 118 will input a delayed low to inverter 119, enabling gate 33 to turn on transistor 120 and energize LED 121 each time the Q output of oscillator 23 goes high. If desired, a flip-flop may be interposed between inverter 119 and gate 33, in the same manner as described above, to provide a latched indication of a clogged air filter.

The hydraulic oil level circuit provides a time delay between opening of switch 48 and the giving of an alarm in the same manner as described in connection with the fuel level circuit. That is, when switch 48 opens and ungrounds the junction of resistors 123 and 124, capacitor 125 will begin to charge so that the voltage thereacross will, in due course be applied through the current limit resistor 126 to gate 34 so that it may turn transistor 127 on and energize LED 128. As before, this will prevent normal sloshing of oil in the hydraulic tank, as will occur in a moving vehicle, from giving a premature alarm and will ensure that the oil level is in fact low before an alarm is given.

The monitoring circuit for the alternator voltage is as follows. Resistors 131, 132 and 133 are connected from the positive terminal of alternator 135 to ground, resistor 132 being adjustable to set the normal voltage level of junction 136. This junction is connected by diode 137 and resistor 138 to positive bus 22, and the lower end of resistor 138 is connected through inverter 139 and delay circuit 141 to NAND gate 35. If the junction 136 is above the potential on bus 22, diode 137 will be backbiased so that inverter 139 will have a high input and low output. When the voltage at junction 136 drops sufficiently in response to an undesirably low alternator voltage output condition, the conduction of diode 137 will cause the inverter input to become sufficiently low that it outputs a high to gate 35. The gate will then turn on transistor 142 and energize LED 143 each time the Q output of oscillator 23 is high.

As before, the indicator circuits on FIG. 1B may be tested by closing test switch 89. With transistor 92 on (FIG. 1A), the now high across resistor 96 will be applied (FIG. 1B) through diodes 146, 147 and 148 to gates 32, 33 and 34 so that LED's 114, 121, 128 will be energized each time the Q output of oscillator 23 goes high. Gate 35 could be similarly acted upon to cause LED 143 to be energized. However, as shown, the junction between diode 137 and resistor 138 is connected by diode 149 to the collector of transistor 92, which is normally high when test switch 89 is open. With test switch 89 closed, and transistor 92 on, the collector goes low, and diode 149 conducts to lower the input to inverter 139 so that its output goes high and causes gate 35 to turn on LED 143.

As will be noted, the LED's on FIG. 1A are only energized during the portion of the cycle of oscillator 23 when its $\overline{Q}$ output is high, while the LED's on FIG. 1B are only energized during the balance of the cycle of oscillator 23 when its Q output is high. This multiplexing operation is advantageous in that power consumption is minimized since only half of the LED's can be energized at a given time. Cutting the maximum possible power consumption in half allows optimizing the power supply design of the circuit to make it functional over a wide range of input levels from the vehicle battery.

As described above, if there is an operating fault or malfunction, a particular LED will be illuminated to provide a warning signal of relatively low intensity to the vehicle operator, which signal will also identify which particular fault exists. Some faults are not sufficiently critical in nature to require further warning. As for example, in the present disclosure, a clogged air filter or oil filter, or a low generator voltage merely causes the LED corresponding thereto to be energized. Other faults may require more immediate attention on the part of the operator. For example, the coolant temperature may get too high or the fuel level may get too low. In the present invention, a relatively high-intensity master light is caused to be illuminated in the event of either occurrence, to attract the attention of the operator. Still other faults may be of such critical nature that prompt corrective action must be taken to avoid damage to the vehicle. As for example, in the present application, the high-intensity light will be lit and a horn will be sounded in the event there is a loss of engine coolant, engine oil or hydraulic fluid.

FIG. 3B shows the circuits which distinguish between the criticality of the faults and which cause the high-intensity light, or light and horn to operate.

The coolant temperature switch 43 and fuel level switch 44 (FIG. 1A) are connected through resistors 151 and 152 to the inputs of NOR gate 153 (FIG. 1C). Similarly, the coolant flow switch 41, engine oil pressure switch 42 (FIG. 1A) and hydraulic oil level switch 48 (FIG. 1B) are connected to the inputs of NOR gate 154 (FIG. 1C). Each of the NOR gates 153 and 154 comprises a gate means having a plurality of inputs and an operative output when an operative signal is applied to any of the inputs. In the present embodiment, each of the gates, an operative high signal at any input will result in an operative low output. Normally all of these inputs are low, and both gates 153 and 154 will have a high output.

If either (or both) of switches 43 or 44 should open, the output of gate 153 will go low and around the lower end of resistor 156 through diode 157, regardless of the output state of gate 154. Similarly, if any of switches 41, 42 or 48 should open, the output of gate 154 will go low and ground the lower end of resistor 156 through diode 158.

The lower end of resistor 156 is connected to the input of inverter 159 whose output is coupled by zener diode 161 and diode 162 to pin 6 of timer 163 which is connected for astable oscillation at a frequency determined by the values of resistors 164 and 165 and capacitor 166 in its external circuit. If desired, a commercially available Signetics SE 555 Monolithic integrated timer circuit, having pin terminals as numbered herein, may be used for timer 163.

With no fault condition existing, and with a low output from inverter 159, diode 162 will prevent capacitor 166 from charging to the threshold level of the timer and will thus keep it from oscillating. The timer output, at pin 3, will be high. If a fault condition exists which causes the output of either gate 153 or gate 154 to go low, the output of inverter 159 will go high, allowing capacitor 166 to charge sufficiently to start the timer into operation. The values of resistors 164 and 165 are preferably chosen so that when timer 163 does oscillate, its output will be high, and inoperative, for two seconds and then low, and operative, for one second during a cycle of oscillation.

The output of timer 163 is coupled by resistor 167 to a transistor 168. With a normally high output from the timer, transistor 168 will be in conduction and transistor 169 will be held off. When a fault exists which causes timer 163 to operate, transistor 168 will be turned off during the one-second low operative output from timer 163 and transistor 169 will be turned on, to complete the power circuit to the relatively high-intensity master light 170.

Thus, the existence of any fault in a condition monitored by gates 153 and 154 will cause the master light 170 to flash on and off at the rate and for the duration determined by timer 163. The presence of the visual signal from the relatively high-intensity light 170 will alert the operator and he can then inspect the relatively low-intensity LED's to see what the specific fault is.

The output of timer 163 is also connected through resistor 171 to the base of transistor 172 so that the horn 173, whose operating coil is in series with a transistor 174, may be energized in response to the existence of a more critical fault. The output of the more-critical-condition NOR gate 154 is also coupled by resistor 175 to the base of transistor 172.

If a more critical fault exists, the low output from both gate 154 and timer 163 will cause transistor 172 to turn off and turn transistor 174 on so that the horn is energized. The warning indication from this auxiliary warning device is sensibly different from that of light 170 and gives a more urgent signal to the vehicle operator.

If a less critical fault exists, the normally high output from gate 154 will continue to be applied to the base of transistor 172 to maintain it in conduction even though the output of timer 163 went low in response to the existence of a less critical fault. Thus, the horn will only be energized for a more critical fault.

In order to prevent the horn from sounding when the engine is not running, the power circuit to the horn is completed through the normally open contacts of the fuel pressure switch 176. These contacts will close when the engine is in operation and the fuel pump has created sufficient fuel pressure.

In the event the horn 173 is not equipped with an internal oscillator, oscillator 177 is utilized for this purpose. Oscillator 177 is a timer, similar to timer 163, connected as a free-running astable oscillator and oscillating at a frequency suitable for horn operation, e.g., 1000 Hz. The output of oscillator 177 is inverted by inverter 178 and applied through diode 179 to the base of transistor 172. If the output of inverter 178 is not grounded by switch 181, then repeated positive pulses will be applied to transistor 172 through diode 179 to repeatedly turn the transistor on during the one-second periods of time that the output of gate 154 and timer 163 are both low. If the horn does have an internal oscillator, switch 181 is closed to ground the output of inverter 178 so that oscillator 177 will have no effect on transistors 172 and 174.

Figure 2:
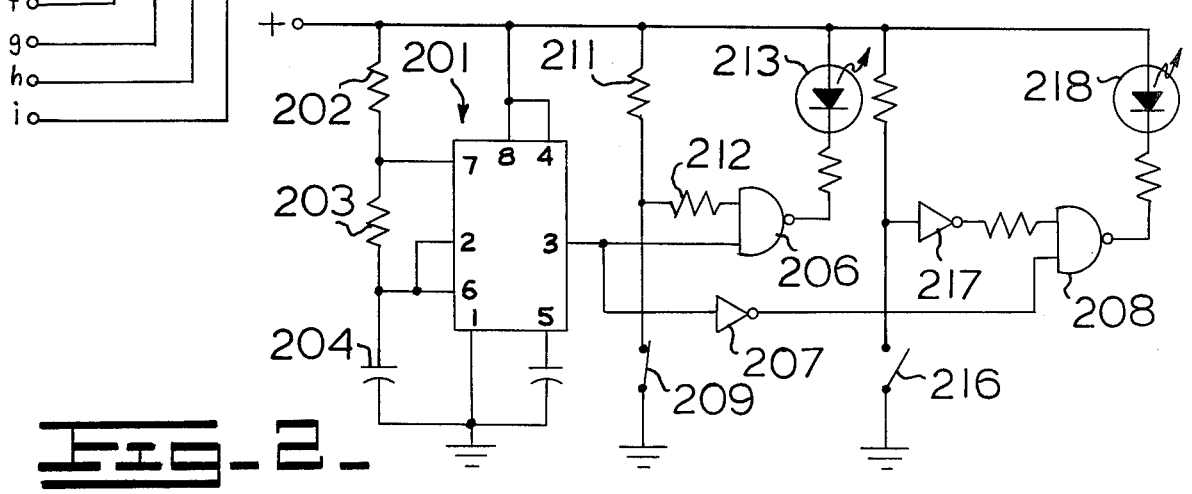
FIG. 2 is a modification of the invention utilizing a different multiplexing oscillator and a different manner of driving the indicator lights.

FIG. 2 illustrates several modifications of the multiplexed LED indicator circuits. For example, in place of the inverter oscillator 23 used in FIG. 1A, a timer 201 is provided, with external resistors 202 and 203 and capacitor 204 having values such that the timer will oscillate at 11 or 12 Hz. with the on-time equal to the off-time. The timer output is connected directly to NAND gate 206 and is inverted by inverter 207 and applied to NAND gate 208. As a consequence, a high will be inputted to gate 206 when a low is applied to gate 208, and vice versa.

If condition-responsive switch 209 opens, to unground the junction of resistors 211 and 212, the output of gate 206 will go low each time the timer has a high output, thus enabling LED 213 to be energized. Obviously, a plurality of LED's could be energized at such time, as in FIG. 1A.

Condition-responsive switch 216 is illustrated as a normally open switch which closes in the event of a fault. With switch 216 open, the input of inverter 217 will be high, and its low output will maintain gate 208 with a high output so that LED 218 is not energized. Closure of switch 216 will ground the inverter input, so that the high output will enable gate 208 to energize LED 218 each time the inverted timer output is high.

The embodiments of the invention in which an exclusive property or privilege is claimed are defined as follows:

1. An improvement in a monitor system for an engine-powered vehicle having a battery and a disconnect switch for connecting said battery to the operational circuits of said vehicle, said vehicle having a plurality of monitor devices, each of which is associated with an operating condition of said vehicle, and each of which is capable of affecting an electrical circuit in response to the existence of an undesirable state of the condition with which the monitor device is associated, the improvement comprising:

(a) a plurality of electrically energizable warning indicators, each of which is associated with a different one of said monitor devices, (b) oscillator means having a first operative output during a portion, and a second operative output during a different portion, of each cycle of operation of said oscillator means, (c) first circuit means operatively associated with a preselected group of said warning indicators and with said oscillator for individually energizing any of said preselected group of indicators in response to an undesirable state condition of the monitor device with which it is associated during, but only during, the first operative outputs of said oscillator means, (d) second circuit means operatively associated with the remaining of said warning indicators and with said oscillator for individually energizing any of said remaining indicators in response to an undesirable state condition of the monitor device during, but only during, the second operative outputs of said oscillator means.

2. The improvement as set forth in claim 1 wherein said first circuit means (c) includes:

(e) at least one gate means having first and second inputs and an operative output during time coincidence of operative signals at both of said inputs, (f) means for energizing one of said indicators in response to the existence of the operative output from said gate means, (g) first coupling means coupling said first input of said gate means to the monitor device associated with said one indicator for applying an operative signal to said first input in response to an undesirable state condition of said monitor device, (h) second coupling means coupling said second input of said gate means to one of said outputs of said oscillator means for applying operative signals to said second input of said gate means in response to operative outputs of said oscillator means.

3. The improvement as set forth in claim 2 wherein said means coupling said first input of said gate means to said monitor device includes a flip-flop means having an input coupled to said monitor device and an output coupled to said first input of said gate means.

4. The improvement as set forth in claim 2, wherein said first coupling means (g) includes time delay means interposed between said monitor device and said gate means for delaying application of said operative signal to said first input of said gate means until said monitor device has remained in an undesirable state condition for a predetermined length of time.

5. The improvement as set forth in claim 1 and further including:

(e) a manually operable test switch having an operative and an inoperative position, (f) means operatively associated with said first circuit means (c) and said second circuit means (d) and operable when said test switch is in its operative position for simultaneously energizing all of said warning indicators of said preselected group during, and only during, the existence of said first operative outputs of said oscillator means, and for simultaneously energizing all of said remaining warning indicators during, but only during, the second operative outputs of said oscillator means.

6. The improvement as set forth in claim 1 wherein said warning indicators are light-emitting diodes.

7. The improvement as set forth in claim 1, wherein all of said warning indicators (a) are sensibly the same when energized and further including:

(e) a master warning indicator sensibly dissimilar, when energized, to said warning indicators (a), (f) means operatively associated with a preselected group of said monitor devices for energizing said master warning indicator in response to an undesirable state condition of any of the monitor devices of said group.

8. The improvement as set forth in claim 7 wherein said warning indicators (a) are relatively low-intensity light-emitting diodes and wherein said master warning indicator is a relatively high-intensity light.

9. The improvement as set forth in claim 7, and further including:

(g) an auxiliary warning indicator sensibly dissimilar, when energized, to said master warning indicator, (h) means operatively associated with a sub-group within said preselected group of monitor devices for energizing said auxiliary warning indicator in response to an undesirable state condition of any monitor device of said sub-group.

10. The improvement as set forth in claim 8 wherein said warning indicators (a) are relatively low-intensity light-emitting diodes, said master indicator is a relatively high-intensity light and said auxiliary warning indicator is an audible device.

11. The inprovement as set forth in claim 1, wherein all of said warning indicators (a) are sensibly similar when energized, and further including:

(e) a master warning indicator sensibly dissimilar, when energized, from said warning indicators (a), (f) a second oscillator means having alternative operative and inoperative outputs, (g) means responsive to the presence of said operative outputs of said second oscillator means for energizing said master warning indicator, (h) means operatively associated with a preselected group of said monitor devices for starting said second oscillator means into operation in response to an undesirable state condition of any monitor device of said preselected group.

12. The improvement as set forth in claim 11 and further including:

(i) an auxiliary warning indicator sensibly dissimilar, when energized, to said master warning indicator, (j) means operatively associated with a sub-group within said preselected group of said monitor devices for energizing said auxiliary warning indicator in response to an undesirable state condition of any monitor device of said sub-group, but only during the existence of operative outputs of said second oscillator means.

13. The improvement set forth in claim 12 wherein said warning indicators (a) are relatively low-intensity light-emitting diodes, wherein said master indicator is a relatively high-intensity light and wherein said auxiliary warning indicator is an audible device.

14. The improvement as set forth in claim 11 and further including:

(i) a horn, (j) a third oscillator means having alternate operative and inoperative outputs of a frequency substantially higher than that of said second oscillator means, (k) means operatively associated with a sub-group within said preselected group of said monitor devices for energizing said horn in response to an undesirable state condition of any monitor device of said sub-group, but only during time coincidence of operative outputs of said second and third oscillator means.

15. The improvement as set forth in claim 1 wherein said warning indicators are sensibly the same and further including:

(e) an audible warning device sensibly dissimilar to said warning indicators, (f) a second oscillator means having alternate operative and inoperative outputs, (g) means operatively associated with a preselected group of said monitor devices for starting said second oscillator means into operation in response to an undesirable state condition of any monitor device of said preselected group, (h) means responsive to said second oscillator means for energizing said audible warning device during the existence of operative outputs of said second oscillator means.

16. The improvement as set forth in claim 1 wherein said warning indicators are sensibly the same and further including:

(e) an audible warning device sensibly dissimilar to said warning indicators, (f) a second oscillator means having alternate operative and inoperative outputs, (g) a third oscillator means having alternate operative and inoperative outputs of a frequency substantially higher than that of said second oscillator means, (h) means operatively associated with a preselected group of said monitor devices for starting said second oscillator means into operation in response to an undesirable state condition of any monitor device of said preselected group, (i) means responsive to said second and third oscillator means for energizing said audible warning device during time coincidence of the operative outputs of said second and third oscillator means.

17. The improvement as set forth in claim 1 and further including:

(e) a gate means having a plurality of inputs, each of said inputs being associated with a different one of a preselected group of said monitor devices, (f) third circuit means for applying an operative signal to each input of said gate means in response to an undesirable state condition of the monitor device associated therewith, said gate means being operable to have an operative output in response to the application by said third circuit means (f) of an operative signal to any of the inputs of said gate means, (g) a second oscillator means having alternate operative and inoperative outputs during each cycle of operation thereof, (h) means for starting said second oscillator means into operation in response to the existence of said operative output of said gate means, (i) a master indicator device, (j) means responsive to operation of said second oscillator means for energizing said master indicator device during each operative output of said second oscillator means.

18. The improvement as set forth in claim 1 and further including:

(e) a first gate means having a plurality of inputs, each of said inputs being associated with a different one of a first preselected group of said monitor devices, (f) third circuit means for applying an operative signal to each input of said first gate means (e) in response to an undesirable state condition of the monitor device associated therewith, said first gate means (e) being operable to have an operative output in response to the application by said third circuit means (f) of an operative signal to any of the inputs of said first gate means, (g) a second gate means having a plurality of inputs, each of said inputs being associated with a different one of a second, and different, preselected group of said monitor devices, (h) fourth circuit means for applying an operative signal to each input of said second gate means (g) in response to an undesirable state condition of the monitor device associated therewith, said second gate means (g) being operable to have an operative output in response to the application by said fourth circuit means (h) of an operative signal to any of the inputs of said second gate means, (i) a second oscillator means having alternate operative and inoperative outputs during each cycle of operation thereof, (j) means for starting said second oscillator means into operation in response to the existence of said operative output of either of said first gate means (e) or said second gate means (g), (k) a master indicator device, (l) means responsive to operation of said second oscillator means (i) for energizing said master indicator device during each operative output of said second oscillator means, (m) an auxiliarly indicator device sensibly dissimilar to said master indicator device, (n) means responsive to operation of said second oscillator means for energizing said auxiliary indicator device during, and only during, time coincidence of the operative outputs of said second oscillator means and said second gate means (g).

19. The improvement as set forth in claim 1 and further including:

(e) a first gate means having a plurality of inputs, each of said inputs being associated with a different one of a first preselected group of said monitor devices, (f) third circuit means for applying an operative signal to each input of said first gate means (e), in response to an undesirable state condition of the monitor device associated therewith, said first gate means (e) being operable to have an operative output in response to the application by said third circuit means (f) of an operative signal to any of the inputs of said first gate means, (g) a second gate means having a plurality of inputs, each of said inputs being associated with a different one of a second, and different, preselected group of said monitor devices, (h) fourth circuit means for applying an operative signal to each input of said second gate means (g) in response to an undesirable state condition of the monitor device associated therewith, said second gate means (g) being operable to have an operative output in response to the application by said fourth circuit means (h) of an operative signal to any of the inputs of said second gate means, (i) a second oscillator means having alternate operative and inoperative outputs during each cycle of operation thereof, (j) means for starting said second oscillator means into operation in response to the existence of said operative output of either of said first gate means (e) or said second gate means (g), (k) a third oscillator means having alternate operative and inoperative outputs during each cycle of operation thereof, said third oscillator means having a frequency of operation substantially higher than that of said second oscillator means, (l) a relatively high-intensity light, (m) means responsive to operation of said second oscillator means for energizing said high-intensity light during each operative output of said second oscillator means, (n) an audible warning device, (o) means responsive to operation of said second oscillator means for energizing said audible warning device during, and only during, time coincidence of the operative outputs of said second and third oscillator means and said second gate means (g).

20. An improvement in a monitor system for an engine-speed vehicle having a battery and a disconnect switch for connecting said battery to the operational circuits of said vehicle, said vehicle having a plurality of monitor devices, each of which is associated with an operating condition of said vehicle, and each of which is capable of affecting an electrical circuit in response to the existence of an undesirable state of the condition with which the monitor device is associated, the improvement comprising:

(a) a plurality of gate means, one for and associated with each of said monitor devices, each gate means having first and second inputs, (b) a plurality of circuit means, each of which is operatively associated with a different one of said plurality of gate means and each of which circuit means is operable to apply an operative signal to the first input of the gate means operatively associated therewith in response to an undesirable state condition of the monitor device associated with said gate means, (c) means including an oscillator forr applying an operative signal simultaneously to the second input of all of a first group of said gate means during a first portion of each cycle of operation of said oscillator and for applying an operative signal simultaneously to the second input of all the remaining gate means during a second and different portion of each cycle of operation of said oscillator, each of said plurality of gate means being operable to have an operative output in response to and during time coincidence of the application by said circuit means of an operative signal to the first input thereof and the application by said means including an oscillator of an operative signal to the second input thereof, (d) a plurality of warning indicators, one for and associated with each of said plurality of gate means, (e) means for individually energizing each of said warning indicators in response to the existence of the operative output of the gate means associated therewith.

21. The improvement as set forth in claim 20 wherein said warning indicators are light-emitting diodes.

22. The improvement set forth in claim 20 and further including:

(f) a manually operable test switch, (g) means responsive to operation of said test switch for applying an operative signal to the first input of all of said gate means of a character which is the same as that of the operative signals applied to said gate means by said plurality of circuit means (d).

23. The improvement as set forth in claim 20, wherein one of said plurality of circuit means (d) includes a bistable flip-flop means having an output coupled to the one of said gate means which is operatively associated with the said one circuit means and an input coupled to the monitor device associated with the one of said gate means.

24. The improvement as set forth in claim 20, wherein one of said plurality of circuit means (d) includes time delay means coupled between the one of said gate means which is operatively associated with said one circuit means and the monitor device associated with the said one of said gate means for delaying the application of an operative signal to the said one of said gate means until the monitor device associated therewith has remained in an undesirable stated condition for a predetermined length of time.

25. The improvement as set forth in claim 20 and further including:

(f) a further gate means having a plurality of inputs, each of said inputs being associated with a different one of a first preselected group of said monitor devices, (g) a further circuit means for applying an operative signal to each input of said further gate means (f) in response to an undesirable state condition of the monitor device associated therewith, said further gate means (f) being operable to have an operative output in response to the application by said further circuit means (g) of an operative signal to any of the inputs of said further gate means, (h) a second oscillator having alternate operative and inoperative outputs during each cycle of operation thereof, (i) means for starting said second oscillator into operation in response to the existence of the operative output of said further gate means (f), (j) a master indicator device, (k) means responsive to operation of said second oscillator for energizing said master indicator device during each operative output of said second oscillator.

26. The improvement as set forth in claim 20 and further including:

(f) a further gate means having a plurality of inputs, each of said inputs being associated with a different one of a first preselected group of said monitor devices, (g) further circuit means for applying an operative signal to each input of said further gate means (f) in response to an undesirable state condition of the monitor device associated therewith, said further gate means (f) means operable to have an operative output in response to the application by said further circuit means (g) of an operative signal to any of the inputs of said further gate means, (h) a still further gate means having a plurality of inputs, each of said inputs being associated with a different one of a second, and different, preselected group of said monitor devices, (i) still further circuit means for applying an operative signal to each input of said still further gate means (h) in response to an undesirable state condition of the monitor device associated therewith, said still further gate means (h) being operable to have an operative output in response to the application by said still further circuit means (i) of an operative signal to any of the inputs of said still further gate means, (j) a second oscillator having alternate operative and inoperative outputs during each cycle of operation thereof, (k) means for starting said second oscillator into operation in response to the existence of the operative input of either of said further gate means (f) or said still further gate means (h), (l) a master indicator device, (m) means responsive to operation of said second oscillator for energizing said master indicator device during each operative input of said second oscillator, (n) an auxiliary indicator device, (o) means responsive to operation of said second oscillator for energizing said auxiliary indicator device during, and only during, time coincidence of the operative outputs of said second oscillator and said still further gate means (h).

27. The improvement as set forth in claim 26 wherein said warning indicators (a) are light-emitting diodes.

28. The improvement as set forth in claim 27 and further including:

(o) a manually operable test switch, (p) means responsive to operation of said test switch for applying an operative signal to the first input of all of said plurality of gate means a character which is the same as that of the operative signals applied to said gate means by said plurality of circuit means (d).

29. The improvement as set forth in claim 20 and further including:

(f) a further gate means having a plurality of inputs and an operative output when an operative signal is applied to any of said inputs, each of said inputs being associated with a different one of a first preselected group of said monitor devices, (g) further circuit means for applying an operative signal to each input of said further gate means (f) in response to an undersirable state condition of the monitor device associated therewith, (h) a still further gate means having a plurality of inputs and an operative output when an operative signal is applied to any of said inputs, each of said inputs being associated with a different one of a second, and, different, preselected group of said monitor devices, (i) still further means for applying an operative signal to each input of said still further gate means (h) in response to an undesirable state condition of the monitor device associated therewith, (j) a second oscillator having alternate operative and inoperative outputs during each cycle of operation thereof, (k) means for starting said second oscillator into operation in response to the existence of an operative output of either of said further gate means (f) or said still further gate means (h), (l) a third oscillator having alternate operative and inoperative outputs during each cycle of operation thereof, said third oscillator having a frequency of operation substantially higher than that of said second oscillator, (m) a master indicator device, (n) means responsive to operation of said second oscillator for energizing said master indicator device during each operative output of said second oscillator, (o) an auxiliary indicator device, (p) means responsive to operation of said second oscillator for energizing said auxiliary indicator device during, and only during, time coincidence of the operative outputs of said second and third oscillators and said still further gate means (h).

30. An improvement in a monitor system for an engine-powered vehicle having a battery and a disconnect switch for connecting said battery to the operational circuits of said vehicle, said vehicle having a plurality of monitor devices, each of which is associated with an operating condition of said vehicle, and each of which is capable of affecting an electrical circuit in response to the existence of an undesirable state of the condition with which the monitor device is associated, the improvement comprising:

(a) a plurality of electrically energizable warning indicators, sensibly similar to each other when energized, each of which is associated with a different one of said monitor devices, (b) circuit means operatively associated with each of said warning indicators and the monitor device associated therewith for individually energizing said warning indicators in response to an undesirable state condition of the monitor device associated therewith, (c) a master warning indicator sensibly dissimilar, when energized, to said warning indicators (a), (d) means operatively associated with a preselected group of said monitor devices for energizing said master warning indicator in response to an undesirable state condition of any of the monitor devices of said group, (e) an auxiliary warning indicator sensibly dissimilar, when energized, to said master warning indicator, (f) means operatively associated with a sub-group within said preselected group of monitor devices for energizing said auxiliary warning indicator in response to an undesirable state condition of any monitor device of said sub-group.

31. The improvement as set forth in claim 30 wherein said warning indicators (a) are relatively low-intensity light-emitting diodes, said master indicator is a relatively high-intensity light and said auxiliary warning indicator is an audible device.

32. An improvement in a monitor system for an engine-powered vehicle having a battery and a disconnect switch for connecting said battery to the operational circuits of said vehicle, said vehicle having a plurality of monitor devices, each of which is associated with an operating condition of said vehicle, and each of which is capable of affecting an electrical circuit in response to the existence of an undesirable state of the condition with which the monitor device is associated, the improvement comprising:

(a) a plurality of electrically energizable warning indicators, sensibly similar to each other when energized, each of which is associated with a different one of said monitor devices, (b) circuit means operatively associated with each of said warning indicators and the monitor device associated therewith for individually energizing said warning indicators in response to an undesirable state condition of the monitor device associated therewith, (c) a master warning indicator sensibly dissimilar, when energized, from said warning indicators (a), (d) an oscillator means having alternative operative and inoperative outputs, (e) means responsive to the presence of said operative outputs for energizing said master warning indicator, (f) means operatively associated with a preselected group of said monitor devices for starting said oscillator means into operation in response to an undesirable state condition of any monitor device of said preselected group.

33. The improvement as set forth in claim 32 and further including:

(g) an auxiliary warning indicator sensibly dissimilar, when energized, to said master warning indicator, (h) means operatively associated with a sub-group within said preselected group of said monitor devices for energizing said auxiliary warning indicator in response to an undesirable state condition of any monitor device of said sub-group, but only during the existence of operative outputs of said oscillator means.

34. The improvement set forth in claim 33 wherein said warning indicators (a) are relatively low-intensity light-emitting diodes, wherein said master indicator is a relatively high-intensity light and wherein said auxiliary warning indicator is an audible device.

35. An improvement in a motor system for an engine-powered vehicle having a battery and a disconnect switch for connecting said battery to the operational circuits of said vehicle, said vehicle having a plurality of monitor devices, each of which is associated with an operating condition of said vehicle, and each of which is capable of affecting an electrical circuit in response to the existence of an undesirable state of the condition with which the monitor device is associated, the improvement comprising:

(a) a plurality of electrically energizable warning indicators, sensibly similar to each other when energized, each of which is associated with a different one of said monitor devices, (b) first circuit means operatively associated with each of said warning indicators and the monitor device associated therewith for individually energizing said warning indicators in response to an undesirable state condition of the monitor device associated therewith, (c) a first gate means having a plurality of inputs, each of said inputs being associated with a different one of a first preselected group of said monitor devices, (d) second circuit means for applying an operative signal to each input of said first gate means in response to an undesirable state condition of the monitor device associated therewith, said first gate means (c) being operable to have an operative output in response to the application by said second circuit means (d) of an operative signal to any of the inputs of said first gate means, (e) a second gate means having a plurality of inputs, each of said inputs being associated with a different one of a second, and different, preselected group of said monitor devices, (f) third circuit means for applying an operative signal to each of said second gate means in response to an undesirable state condition of the monitor device associated therewith, said second gate means (e) being operable to have an operative output in response to the application by said third circuit means (f) of an operative signal to any of the inputs of said second gate means, (g) an oscillator having alternate operative and inoperative outputs during each cycle of operation thereof, (h) means for starting said oscillator into operation in response to the existence of the operative output of either of said first or second gate means, (i) a master indicator device, (j) means responsive to operation of said oscillator for energizing said master indicator device during each operative output of said oscillator, (k) an auxiliary indicator device, (l) means responsive to operation of said oscillator for energizing said auxiliary indicator device during, and only during, time coincidence of the operative outputs of said second oscillator and said second gate means.

36. The improvement set forth in claim 35 wherein said warning indicators (a) are relatively low-intensity light-emitting diodes, wherein said master indicator is a relatively high-intensity light and wherein said auxiliary warning indicator is an audible device.

* * * * *